US006533275B2

(12) United States Patent
Zaruba et al.

(10) Patent No.: US 6,533,275 B2
(45) Date of Patent: Mar. 18, 2003

(54) COLLECTIBLE DICE

(75) Inventors: John V. Zaruba, Oak Park, IL (US); Dino C. Crisanti, Lyons, IL (US); Robert E. G. Annis, Park Ridge, IL (US); Jamie D. MacBain, Chicago, IL (US)

(73) Assignee: Breslow, Morrison, Terzian & Associates, L.L.C., Chicago, IL (US)

( * ) Notice: Subject to any disclaimer, the term of this patent is extended or adjusted under 35 U.S.C. 154(b) by 0 days.

(21) Appl. No.: 09/784,676

(22) Filed: Feb. 15, 2001

(65) Prior Publication Data

US 2002/0109298 A1 Aug. 15, 2002

(51) Int. Cl.[7] ..... A63F 9/04
(52) U.S. Cl. ..... 273/146; 273/138.1; 273/DIG. 14
(58) Field of Search ..... 273/138.1, 139, 273/145 R, 145 A, 145 B, 145 C, 146, 148 R, 292, DIG. 14

(56) References Cited

U.S. PATENT DOCUMENTS

| | | | | | |
|---|---|---|---|---|---|
| 1,446,941 | A | * | 2/1923 | Smith | 428/3 |
| 1,593,907 | A | * | 7/1926 | Madan | 273/146 |
| 2,090,837 | A | | 8/1937 | Gould | |
| D142,576 | S | | 10/1945 | Morris | |
| 2,526,123 | A | * | 10/1950 | Dawson | 273/145 C |
| 2,797,512 | A | * | 7/1957 | Sieve | 40/107 |
| 3,198,523 | A | * | 8/1965 | Stimson | 273/146 |
| 3,258,268 | A | | 6/1966 | Treinis | |
| 3,400,932 | A | * | 9/1968 | Conrad | 273/146 |
| 3,467,382 | A | | 9/1969 | Leadley | |
| 3,495,832 | A | | 2/1970 | Thomassen-Behle | |
| 3,785,651 | A | | 1/1974 | Smith | |
| 3,899,838 | A | | 8/1975 | Lalley | |
| 3,904,208 | A | | 9/1975 | Grossman | |
| 4,124,881 | A | | 11/1978 | Haber | |
| 4,148,488 | A | | 4/1979 | Kohlhagen | |
| 4,164,351 | A | | 8/1979 | Baker | |
| 4,181,304 | A | | 1/1980 | Haber | |
| 4,437,670 | A | | 3/1984 | Simon | |
| 4,634,125 | A | | 1/1987 | Seklecki | |
| 4,641,840 | A | | 2/1987 | Larson | |
| 4,678,191 | A | | 7/1987 | Mills | |
| 4,682,778 | A | | 7/1987 | Willis | |
| 4,874,175 | A | * | 10/1989 | Fischer | 273/146 |
| 4,979,750 | A | | 12/1990 | Endrody | |
| 5,018,738 | A | | 5/1991 | Padi | |
| 5,145,173 | A | | 9/1992 | Crowder | |
| 5,150,900 | A | | 9/1992 | Onzo | 273/146 |
| 5,201,525 | A | | 4/1993 | Castro | |
| 5,215,792 | A | | 6/1993 | Miller | |
| 5,223,958 | A | | 6/1993 | Berry | |
| 5,261,666 | A | | 11/1993 | Chen | |
| 5,287,641 | A | | 2/1994 | Showers | |
| 5,348,300 | A | | 9/1994 | Jennings | |
| 5,662,332 | A | | 9/1997 | Garfield | |
| D385,308 | S | | 10/1997 | Betti | |
| 5,961,117 | A | | 10/1999 | Scarselli | |

* cited by examiner

*Primary Examiner*—Benjamin H. Layno
*Assistant Examiner*—Vishu K. Mendiratta
(74) *Attorney, Agent, or Firm*—Greenberg Traurig

(57) ABSTRACT

A plurality of collectible dice, each including a multi-faceted polyhedron having an opaque base. A three dimensional character is positioned on the base and contained within each die. At least one of the facets of each die, other than the base, is transparent or translucent to permit viewing of the character. Indicia for distinguishing the die and for use in game play are contained on each die. Players obtain a collection of dice from a universe of distinctive dice and establish a set of dice from the collection. A set of dice for use in a given turn of a game is selected from the collection. At least one selected die is cast and the value is determined from a combination of the character contained within the die and the indicia showing on the upwardly facing facet of the die.

8 Claims, 1 Drawing Sheet

COLLECTIBLE DICE

BACKGROUND OF THE INVENTION

1. Field of the Invention

This invention relates generally to dice and more particularly to collectible dice that can be used for playing a game.

2. Background Art

Garfield U.S. Pat. No. 5,662,332 issued Sep. 2, 1997 shows the use of collectible trading cards that are used in playing the game "Magic The Gathering". Indeed, the use of collectible trading cards in playing a game is also shown in Castro U.S. Pat. No. 5,201,525 issued Apr. 13, 1993 and in Crowder U.S. Pat. No. 5,145,173 issued Sep. 8, 1992. Like cards, dice have long been used for playing games. Moreover, the inclusion within dice of something that may, or may not, affect the play of the game using the dice is shown in Morris U.S. Des. Pat. No. D142,576 issued Jan. 1, 1945; Gould U.S. Pat. No. 2,090,837 issued Aug. 15, 1935; Kohlhagen U.S. Pat. No. 4,148,448 issued Apr. 10, 1979, Baker U.S. Pat. No. 4,164,351 issued Aug. 14, 1979; and Jennings U.S. Pat. No. 5,348,300 issued Jul. 21, 1993. Nevertheless, there remains a need for dice which, because of what is contained within, and on, them, makes them collectible and also makes them significant in the play of a game.

SUMMARY OF THE INVENTION

The present invention is concerned with providing collectible dice comprising a plurality of dice, each including a multi-faceted polyhedron having an opaque base facet, with a three dimensional character positioned on the base facet and contained within each die, at least one of the facets of each die, other than the base facet, is transparent or translucent so as to permit viewing of the character; and indicia are contained on at least one facet of each die.

The present invention is also concerned with providing a game that includes obtaining a collection of dice from a universe of distinctive dice, each die of the universe of distinctive dice being multi-faceted and containing a viewable, three dimensional character of a specific nature, and having indicia on at least one facet of the die, so as to be distinguishable from each other die of the universe, establishing a set of dice from the collection, selecting at least one of the set of dice for use in a given turn of the game, casting the at least one selected die, and determining the value of the cast from a combination of the character contained within the die and the indicia showing on the upwardly facing facet of the die after it has been cast and come to rest.

BRIEF DESCRIPTION OF THE DRAWINGS

For a better understanding of the present invention, reference may be had to the accompanying drawings in which.

DETAILED DESCRIPTION

Figure 1:
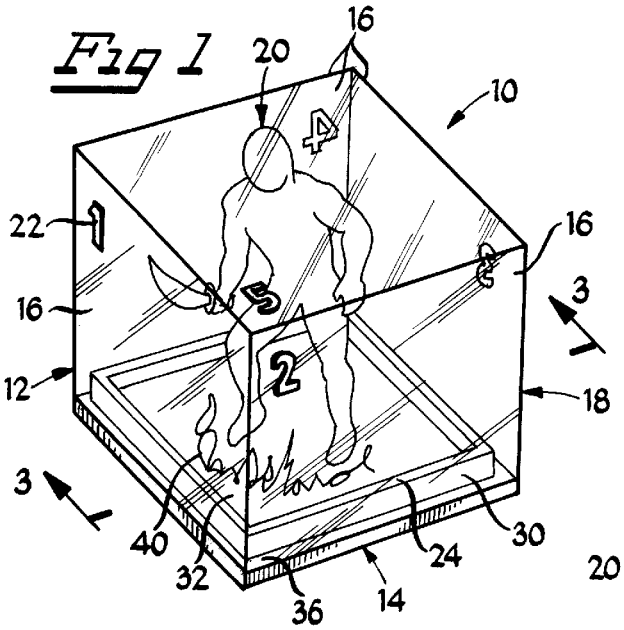
FIG. 1 is a perspective view of an embodiment of the present invention.

Referring now to the drawings in which like parts are designated with like reference numerals throughout the several views, there is shown in FIG. 1 a collectible die 10. A plurality of dice, each similar to die 10, except as will be discussed below, make up the collectible dice of the present invention. Each die 10 includes a multi-faceted polyhedron 12, which in the illustrated embodiments is a cube. However, it will be apparent to those skilled in the art that the multi-faceted polyhedron may have more or less than the six facets or sides of the cube.

Base facet 14 is opaque. The remaining five facets 16 are substantially transparent. Together, facets 16 form an open ended die or cover 18 for base facet 14. Within the polyhedron, or cube, 12 is a three dimensional character 20. Each of the facets 16 may be translucent so long as character 20 may be viewed through such translucent facets. Indicia, such as numerals 22, are carried on each facet 16. While illustrated in the Figures as being in the upper left hand corner of each facet 16, indicia 22 may be disposed anywhere on the facet, and be of any convenient size, shape or type, so long as viewing of character 20 is not substantially obscured.

Figure 2:
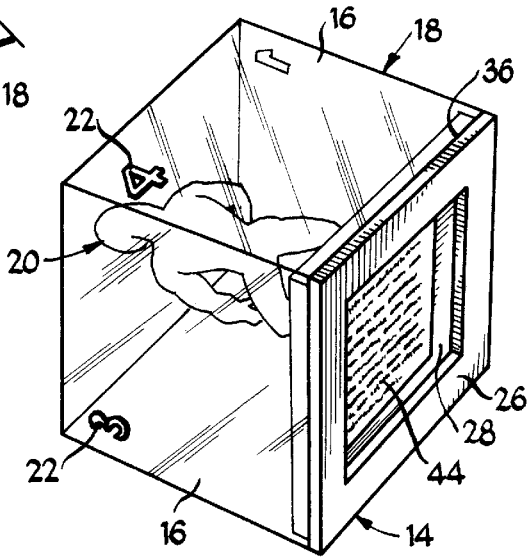
FIG. 2 is another perspective view of the same embodiment shown in FIG. 1 rotated ninety (90°) degrees.
Figure 3:
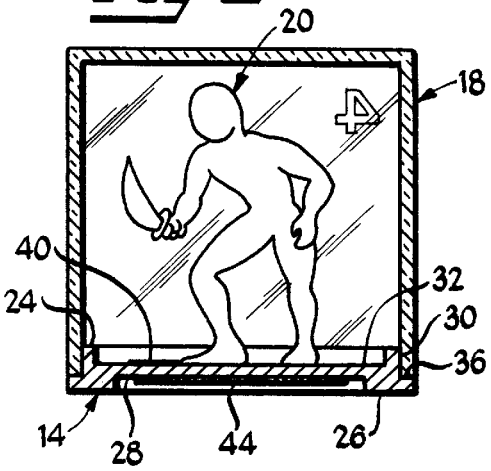
FIG. 3 is a sectional view taken generally along line 3—3 of FIG. 1.

As is better illustrated in FIGS. 2 and 3, base facet 14 also has an inner side 24 and an outer side 26 opposed to inner side 24. Base facet 14 is conveniently formed with a generally centrally disposed recess 28 in outer side 26. In addition, as is illustrated in FIGS. 1 and 3, base facet 14, or more particularly, inner side 24 of base facet 14 is formed with a peripheral wall 30 defining a recess 32 in which character 20 is positioned. Again, as is best illustrated in FIGS. 1 and 3, peripheral wall 30 is inwardly offset so as to define a ledge 36 about which four of the facets 16 are positioned.

The five facets 16 forming the open ended cube or cover 18 may conveniently be molded as a single piece from any of a number of plastic materials readily known to those in the art for making such pieces. Moreover, cover 18 may be molded as a matrixed gang-mold allowing for different covers to have different indicia 22, or different combinations of indicia 22. The open ended cover 18 is positioned upon, and may be secured to base facet 14 by suitable adhesives, ultrasonic or radio frequency welding or other suitable ways of substantially permanently securing plastic materials such as those from which cover 18 and base facet 14 are made.

Character 20 is generally molded of any one of a number of plastic materials available for such purposes. Character 20 is positioned within recess 32 on inner side 24 of base facet 14 and secured by suitable adhesives, ultrasonic or radio frequency welding, or other ways available for securing such plastic materials to each other. In addition, further identification of character 20, such as the character's name 40, may be included on inner side 24 of base facet 14.

Within recess 28 of outer side 26 of base facet 14 is another indicia 44. Because base facet 14 is opaque, indicia 44 is generally obscured from view when a particular die 10 is positioned, as illustrated in FIG. 1, with character 20 in a generally upright posture and viewable through each of the five transparent facets 16. Indicia 44 may describe specific attributes or powers related to the particular character 20 within the die. Unlike indicia 22 on the transparent or translucent facet 16, which are generally concise and comprise a single numeral, alphabet letter, or symbol, indicia 44 may be more extensive and provide for different alternatives. For example, the power of the particular character may be enhanced or diminished depending upon the character contained within, or the indicia on the upward facing facet of, an opponent's die. In addition, indicia 44, though related to a particular character 20 contained within the die may differ from one die containing the particular character 20 to another die containing the same character 20.

Different characters, which may conveniently represent characters in a book or movie, help distinguish one die from other of the collectible dice. Such distinction may result from the identity of the character itself, the pose of the character, including the nature of a weapon held by the character, the color scheme of the character, or any combination of these. One die is further distinguished from others by the indicia on the facets of the die. Thus, a die containing a particular character, in a particular pose, and in a particular color, may nevertheless be distinguished from another die containing that same character in the same pose and of the same color by a different combination of indicia on facets 16. In addition, base facet 14 may be made of different colors, thus further increasing the number of possible distinguishable combinations. Moreover, indicia 44 on the outer side of base facet 14 can be different, even if the character, pose, color and indicia on facets 16 are otherwise identical.

Figure 4:
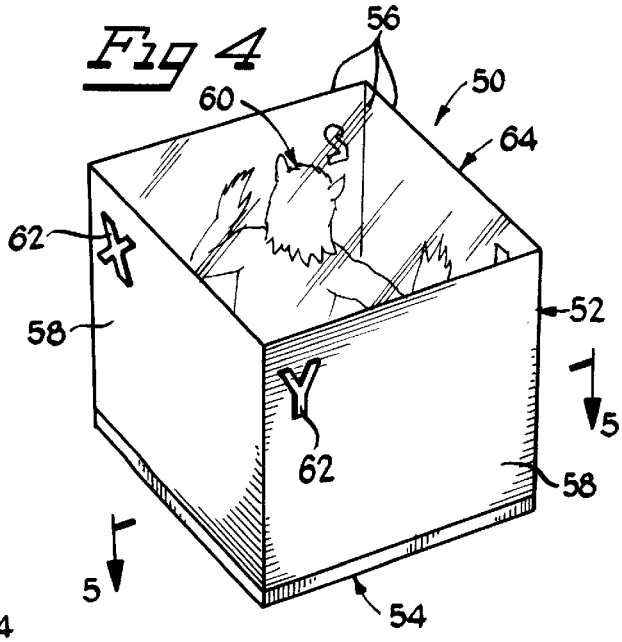
FIG. 4 is a perspective view of another embodiment of the present invention.
Figure 5:
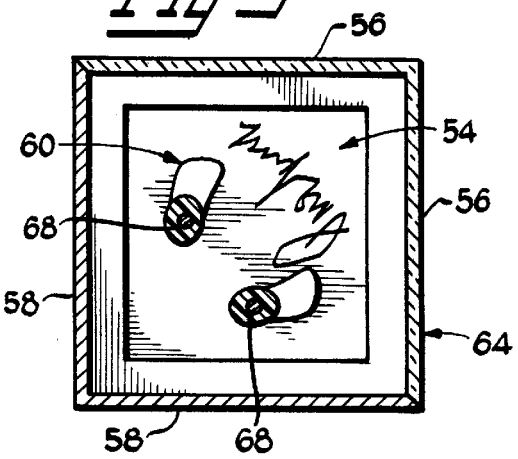
FIG. 5 is a sectional view taken generally along line 5—5 of FIG. 4.

FIGS. 4 and 5 illustrate an alternative embodiment of the present invention in which additional facets are opaque. Thus, a die 50 in the form of cube 52 may have, in addition to its opaque base facet 54, and three transparent facets 56, an additional two opaque facets 58. Such an alternative embodiment presents a different aesthetic appearance providing more of a back drop or background for a character 60 contained within the die. In addition, the two additional opaque facets 58 can contain indicia 62 that are generally obscured from an opponent's view prior to use of the die in play.

As another alternative, five sided, open ended cover 64 may merely frictionally engage the ledge (not shown), similar to ledge 36 in FIGS. 1–3, permitting removal of the cover from base facet 54. In addition, character 60 may be positioned on base facet 54 by frictional engagement of apertures extending from the underside of the character's feet with pegs 68 extending upwardly from base 54. Thus, open ended die cover 64 may be removed from base facet 54 and a different character 60 may be placed on the base permitting players to exchange characters, base facets, and open ended covers to create unique dice.

Game play with the collectible dice may range from a simple war-type play in which each player casts or rolls a single die, to more complex games involving playing dice in a particular sequence or combination to best utilize their power. Depending upon the specific instructions or directions included in indicia 44, it could affect not only the outcome of the particular die cast in which it turns up, but may also affect future play, such as the number of casts, or number of dice, available to a player. In order to bring the instructions or directions contained in indicia 44 into play more often, one of indicia 22 could bring indicia 44 into play as if outer side 26 of base facet 14 turned up in the cast.

While particular embodiments of the invention have been shown and described, with some further suggested alternatives, further variations and modifications will occur to those skilled in the art. It is intended in the appended claims to cover all such variations and modifications that come within the true spirit and scope of the present invention.

What is claimed as new and desired to be secured by Letters Patent is:

1. Collectable dice comprising:

a plurality of dice;

each die including a multi-faceted polyhedron;

each polyhedron having an opaque base facet;

the base facet having an inner side and an opposed outer side;

a three dimensional character positioned on the inner side of the base facet and contained within each die;

at least one of the facets of each die, other than the base facet, being transparent or translucent so as to permit viewing of the character;

indicia contained on at least one facet of each die; and the opposed side of the base facet carrying indicia related to the character.

2. The collectable dice of claim 1 in which a die is distinguished from other of the collectable dice by the three dimensional character contained within the die.

3. The collectable dice of claim 2 in which different dice contain three dimensional characters of different identities, and a die is distinguished from other of the collectable dice by the identity of the three dimensional character contained within the die.

4. The collectable dice of claim 2 in which different dice contain three dimensional characters in different poses, and a die is distinguished from other of the collectable dice by the pose of the three dimensional character contained within the die.

5. The collectable dice of claim 2 in which different dice contain three dimensional characters of different colors, and a die is distinguished from other of the collectable dice by the color of the three dimensional character contained within the die.

6. The collectable dice of claim 2 in which different dice contain three dimensional characters of different identities, poses, and colors, and a die is distinguished from other of the collectable dice by the identity, the pose and the color of the three dimensional character contained within the die.

7. The collectable dice of claim 2 in which a die is distinguished from other of the collectable dice by the three dimensional character contained within the die and the indicia on the facets of the die.

8. The collectible dice of claim 2 in which the base facets of different dice are of different colors, and a die is distinguished from other of the collectible dice by the color of the base facet.

* * * * *